US005390432A

United States Patent [19]

Boulud et al.

[11] Patent Number: 5,390,432

[45] Date of Patent: Feb. 21, 1995

[54] WATER DISTRIBUTION SCREEN ON A COATED STEAM IRON VAPORIZATION CHAMBER

[75] Inventors: Henry Boulud, Diemoz; Christian Giovalle, Pont Eveque, both of France

[73] Assignee: SEB S.A., Ecully Sedex, France

[21] Appl. No.: 128,067

[22] Filed: Sep. 28, 1993

[51] Int. Cl.[6] ..... D06F 75/18

[52] U.S. Cl. ..... 38/77.83

[58] Field of Search ..... 38/77.81, 77.82, 77.83, 38/93, 77.7, 77.9; 219/254, 258

[56] References Cited

U.S. PATENT DOCUMENTS

| | | | |
|---|---|---|---|
| 2,683,320 | 2/1954 | Morton | 38/77.83 |
| 2,777,224 | 1/1957 | Lehmann | 38/77.83 |
| 2,792,652 | 5/1957 | Dawson | 38/77.83 |
| 2,815,592 | 12/1957 | Gomersall | 38/77.83 |
| 2,967,365 | 1/1961 | Extale et al. | 38/77.83 |
| 3,115,718 | 12/1963 | Henzirohs | 38/77.83 |
| 3,407,522 | 10/1968 | Jepson et al. | 38/77.83 X |
| 3,694,942 | 10/1972 | Vondracek et al. | 38/77.83 |
| 4,716,276 | 12/1987 | Motegi et al. | 219/253 |
| 5,060,406 | 10/1991 | Verweij et al. | 38/77.83 |

FOREIGN PATENT DOCUMENTS

| | | | |
|---|---|---|---|
| 0126809 | 2/1948 | Australia | 38/77.83 |
| 0055229 | 6/1982 | European Pat. Off. . | |
| 1353447 | 1/1964 | France | 38/77.83 |
| 3006783 | 8/1981 | Germany . | |
| 2268800 | 11/1990 | Japan | 38/77.83 |
| 0773741 | 5/1957 | United Kingdom | 38/77.83 |

*Primary Examiner*—Clifford D. Crowder
*Assistant Examiner*—Ismael Izaguirre
*Attorney, Agent, or Firm*—Spensley Horn Jubas & Lubitz

[57] ABSTRACT

A steam pressing iron having a soleplate presenting an ironing surface and having steam outlet openings; a steam generating structure disposed adjacent the soleplate and defining a water vaporization chamber having a bottom surface; a device for heating water in the vaporization chamber; a covering of a material selected to promote vaporization of water disposed on the bottom surface of the vaporization chamber; and a screen disposed above the covering for distributing water across the covering.

21 Claims, 2 Drawing Sheets

WATER DISTRIBUTION SCREEN ON A COATED STEAM IRON VAPORIZATION CHAMBER

BACKGROUND OF THE INVENTION

The present invention relates to the general field of vaporizing apparatus, and particularly to steam-pressing irons in which it is necessary to assure the vaporization of a liquid before its expulsion in the form of steam.

The invention is particularly concerned with steam irons of the type having a pressing soleplate, heating means and a vaporization chamber provided with a coating which promotes the vaporization of the pressing liquid, which is generally water.

As is known in fields relating to the generation of steam, water droplets projected onto a hot surface tend to resist vaporization and to remain in the form of liquid droplets and to circulate rapidly and in a random manner across the surface. This phenomenon is known as calefaction.

It is already known in the art to improve the quality of the vaporization of water by applying to the bottom of the vaporization chamber of the iron a coating, such as of sodium silicate. This product, or other equivalent products, are known for their hydrophilic and wettability properties which assure a spreading and a distribution of the water across the bottom of the vaporization chamber. One thus obtains a better vaporization of the water, which translates into a reduction in the expulsion of water in liquid form through steam passages formed in the soleplate.

Experience has shown that the use of such coatings is not sufficient to assure an effective vaporization, in particular in modern pressing irons which are constructed to produce high steam outputs, for example equal to or greater than 30 grams per minute. Thus, coatings of the sodium silicate type have a resistance to thermal shocks which is less than totally desirable, and a limited adherence to the bottom of the vaporization chamber. There has also been noted a marked tendency for the materials employed for such coatings to dissolve in water, thereby significantly reducing the useful life of the pressing irons.

In addition, it is known in the prior art, as disclosed for example in German Laid-Open Application (DE-OS) A-3 006 783, to dispose a screen of metal wires directly on the bottom of a vaporization chamber.

The provision of such a screen, however, does not sufficiently limit the phenomenon of calefaction and the vaporization performance is thus found to be insufficient for use in an iron which must generate a substantial quantity of steam.

It has moreover also been noted that the manipulations performed on a pressing iron during ironing cause the body of water contained in the vaporization chamber to experience continuous movements. Such movements interfere with a good distribution of the water and have a negative influence on the quantity of steam generated.

SUMMARY OF THE INVENTION

A primary object of the present invention is to overcome the drawbacks enumerated above and to furnish a steam iron which exhibits an improved steam generation performance regardless of manipulations or movements to which the iron is subjected.

Another object of the invention is to provide a steam iron in which the distribution of water in the vapor chamber is improved by the provision of particularly simple and effective components.

The above and other objects are achieved, according to the present invention, by the provision, in a steam pressing iron, of:

- a soleplate presenting an ironing surface and having steam outlet openings;
- a steam generating structure disposed adjacent the soleplate and defining a water vaporization chamber having a bottom surface;
- means for heating water in the vaporization chamber;
- a covering of a material selected to promote vaporization of water disposed on the bottom surface of the vaporization chamber; and
- a screen disposed above the covering for distributing water across the covering.

The characteristics and advantages of the invention will become more readily apparent from the following description of a preferred embodiment, given only by way of non-limiting example.

DESCRIPTION OF THE PREFERRED EMBODIMENTS

Figure 1:
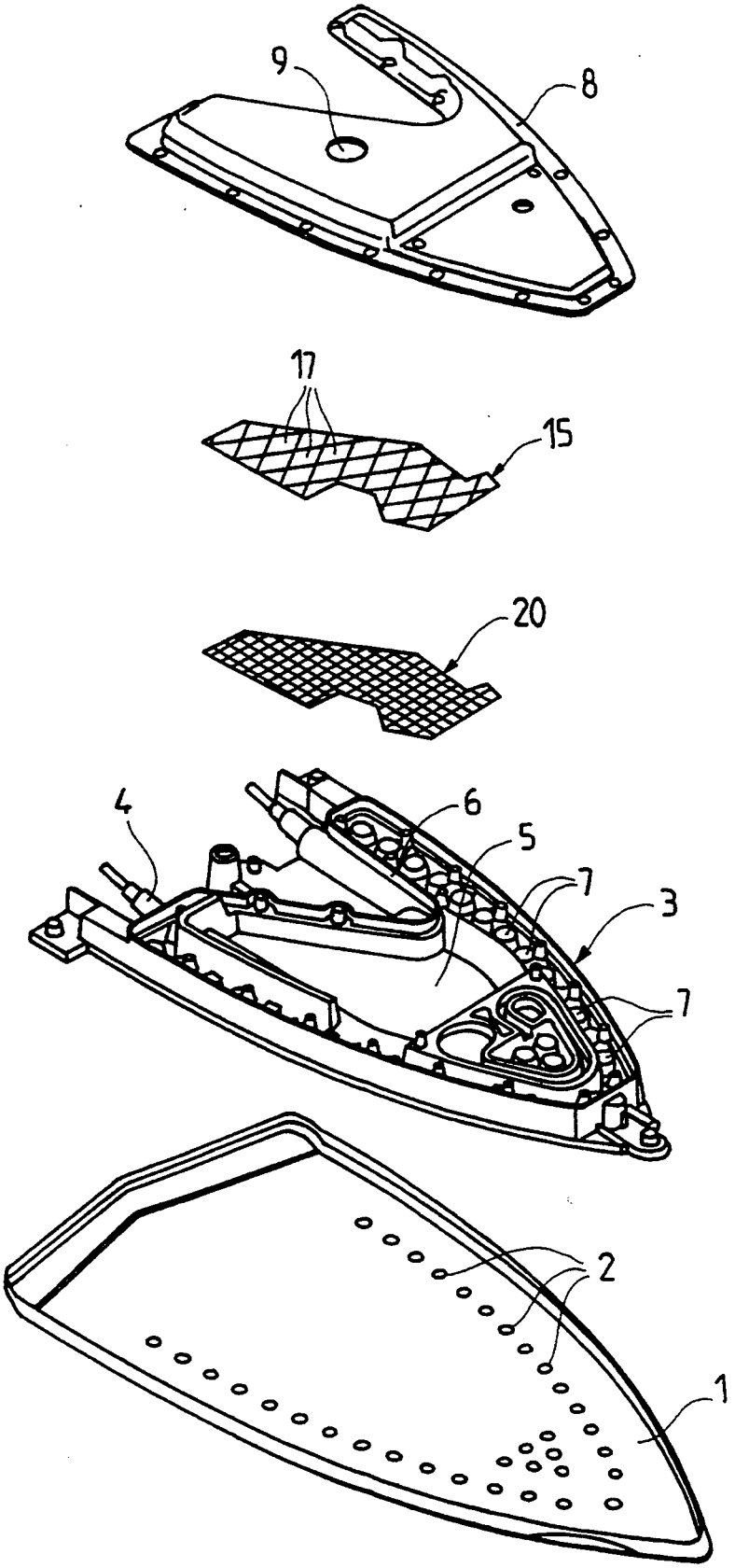
FIG. 1 is an exploded perspective view of the steam chamber and soleplate portion of a steam iron according to the invention.

FIG. 1 shows the portion of a steam iron according to the invention which constitutes a vaporization chamber and an ironing soleplate. The iron will be completed in a conventional manner by a housing, handle, controls, etc. The illustrated structure includes a pressing soleplate 1 provided with steam delivery passages 2. On soleplate 1 there is fixed, by any appropriate means, a metal heating structure 3 provided with heating means 4 constituted, for example, by a heating resistance encased within an insulating sheath. Heating structure 3 delimits, in a known matter, a vaporization chamber 5 connected by at least one channel 6 to a series of perforations 7 aligned with steam passages 2. The totality of the heating structure 3 is closed by a cap 8 which is secured to structure 3. Vaporization chamber 5 is coupled to a water reservoir (not shown), which forms part of the pressing iron, by the intermediary of a passage 9 extending through cap 8. Passage 9 is located above vaporization chamber 5 and is coupled to the reservoir by means which allow for a controlled flow of water from the reservoir into vaporization chamber 5.

Figure 2:
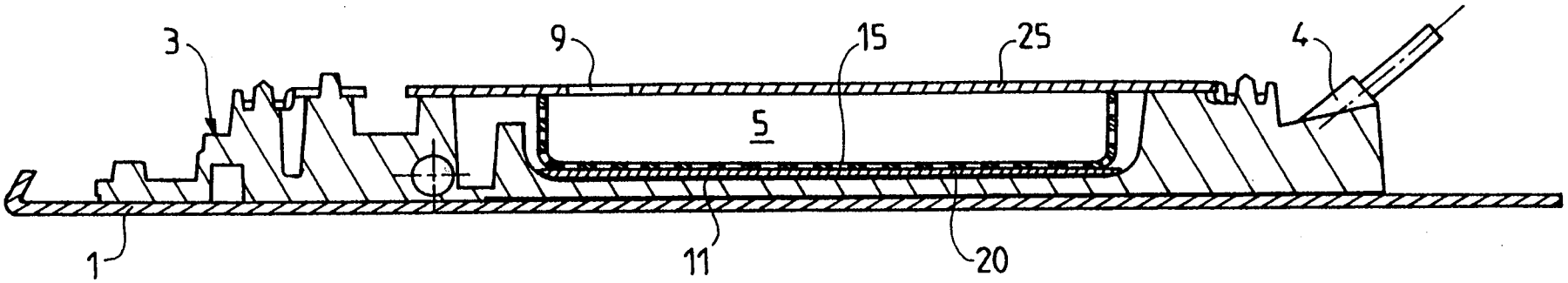
FIG. 2 is a longitudinal cross-sectional view taken in a vertical longitudinal plane of the structure shown in FIG. 1.
Figure 3:
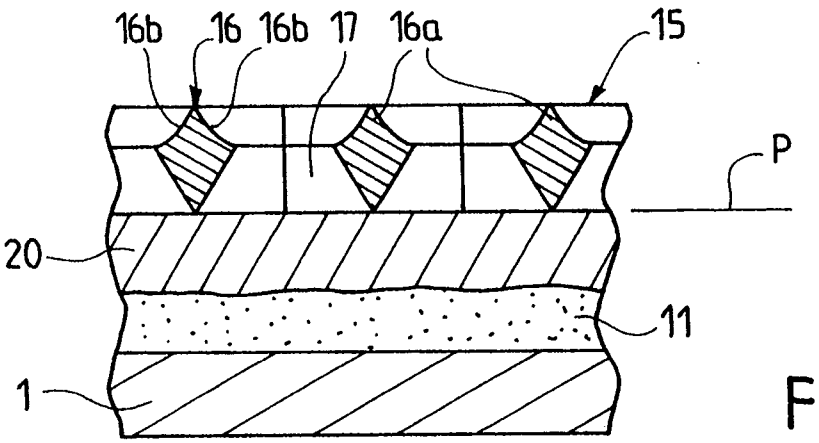
FIG. 3 is a cross-sectional detail view to an enlarged scale, showing the structure of the bottom of the vaporization chamber of the iron according to the present invention, in the region enclosed by circle III in FIG. 2.

In the simplest embodiment of the present invention, vaporization chamber 5 is provided with covering in the form of a coating 11, shown in FIGS. 2 and 3, extending across at least a part of the bottom of vaporization chamber 5 in order to promote the vaporization of the water. Coating 11 is composed of at least one layer of a material having good hydrophilic and/or wettability properties intended to promote, respectively, spreading of the water over the surface of coating 8 and absorption of the water into the coating. Preferably, coating 11 also has bonding properties which promote its adhesion to the bottom of the vaporization chamber. Also preferably, coating 11 is chosen from among materials having good thermal isolation properties in a manner to constitute a thermal barrier permitting a relative lowering of the temperature of the vaporization chamber in order to promote vaporization. Coating 11 thus forms a first layer which can be selected advantageously from among materials such as sodium silicate, calcium carbonate, paints, varnishes, cements, e.g., Fiber Frax (TM), silica-based compounds, other carbonates, metallic oxides, enamels, or compounds capable of being formed by plasma deposition.

In the simplest embodiment of the invention, vaporization chamber includes, above coating 11, a screen 15 for distributing water. Screen 15 extends preferably over the totality of the bottom of vaporization chamber 5 and is advantageously in direct contact with that bottom. Screen 15 can be disposed at some distance above the bottom of vaporization chamber 5 and for example at a distance of one or two millimeters thereabove. Screen 15 is provided, at least at the location of passage 9, with a part 16 shaped to deflect and distribute water over the surface of coating 11. Preferably, part 16 consists of a series of bands 16*a* projecting above a lower boundary plane P of screen 15. Screen 15 forms, as shown for example in FIG. 1, a series of openings 17 forming the network of screen 15. Advantageously, bands 16*a* surround at least partially, but preferably completely, opening 17. The heights, H, of bands 16*a* starting from plane P, advantageously has an average value of between 0.5 and 5 millimeters, and preferably between one and three millimeters. The transverse cross-section of bands 16*a* is preferably diamond-shaped, i.e., has the form of a quadrilateral with two pairs of mutually adjacent sides, the sides of one pair being longer than the sides of the other pair. One corner of this shape is oriented in such a manner as to constitute the highest point of the band, as shown in FIG. 3. The two upper faces 16*b* of the bands 16*a* thus constitute surfaces for deflecting and distributing water which is intended to be vaporized, and thus distribute the total volume of water in a homogenous manner within openings 17, and as a result across the entire surface of vaporization chamber 5. Surfaces 16*b* can obviously be linear or curved, or can even be irregular and for example provided with recesses or grooves. The form of openings 17, in a horizontal plane, can be hexagonal, honeycomb, or square, and is preferably similar to a diamond shape. Preferably, screen 15 is made of a metal, preferably of aluminum or an aluminum alloy, or from any other rust-resistant metal, which has been stamped to form openings 17 and then stretched, or expanded, to its desired final shape.

According to another embodiment of the invention, screen 15 can be coated, at least partially, by a hydrophilic and wettable material. Preferably, screen 15 is coated in its totality with a layer of sodium silicate in order to promote spreading of water even at the level of screen 15.

According to another embodiment of the invention, as shown in FIG. 1, the covering for the bottom of chamber 5 includes, in addition to the first layer 11, a second layer 20 constituted by a water permeable, filamentary and/or fibrous material having hydrophilic and water wettability properties. The second layer 20 preferably extends over the totality of the surface of the first layer 11 and is selected from among materials such as woven fiberglass, aramid felts or fibers (for example, NOMEX (TM), mineral fibers, carbon fibers, fiberglass, metal fabrics or expanded micro-metal fabrics. As is shown in FIG. 1, the second layer 20 can be constituted of a material constituting a mesh or screen having square or diamond-shaped openings, for example, with an average dimension smaller than that of openings 17 in screen 15 in order to constitute a second level for breaking up and channeling drops of water. Advantageously, equally, the second layer 20 is formed of a material including in its structure a thermally conductive element such as a metallic paste of aluminum or of zinc. It is thus assured that, at the level of the second layer 20, there is a mechanical distribution of the water droplets throughout the thickness and at the same time at the surface of the layer 20, and a pre-vaporization of the water by a complementary supply of heat provided by the metallic paste. The second layer 20 is advantageously formed to have an average weight of between 30 and 500 grams per square meter, and preferably between 100 and 150 grams per square meter.

Screen 15 is supported against the second layer 20 by any appropriate means, and for example with the aid of a plate 25, shown in FIG. 2. Plate 25 also serves to close the top of vaporization chamber 5. In such an embodiment, screen 15 can have the form of a basin which also extends, or lies, against the lateral, or vertical, walls of vaporization chamber 5 and is maintained in position by being pressed down by plate 25.

The functioning of the structure shown in the drawings and described above in a pressing iron according to a preferred embodiment of the invention is the following.

Water coming from the reservoir (not shown) flows via passage 9 into vaporization chamber 5 and the water drops undergo a first mechanical division, or fragmentation, at the level of screen 15 and advantageously at the level of bands 16*a*. This first mechanical effect assures an initial distribution of water droplets in vaporization chamber 5. The distribution of water droplets is then increased during passage of the droplets to the level of the second layer 20 where the water experiences a spreading at the level of the surface of layer 20. Then, the water undergoes a diffusion and a further spreading out through the thickness of layer 20.

Finally, the distribution of the water droplets can be considered as optimal and complete at the level of coating 11 which thus forms the third level of distribution. Moreover, it has been found that the use of screen 15 as a compression element assures, in cooperation with the bonding and adhesion properties of coating 11, a mechanical retention of the multi-layer assembly, which is particularly high and stable over the long-term. In addition, it has been noted that regardless of the manipulations and displacements of the pressing iron during ironing, preferential zones of diffusion of water droplets are particularly reduced. In effect, the deflection and distribution of the water are considered as satisfactory from the time of contact of the droplets at the level of screen 15, each opening 17 channeling water droplets and preventing or at least substantially limiting all transversal displacements of these water droplets. Good results have been obtained with the combination of a screen 15 and a coating 11.

In embodiments of the invention, the calefaction phenomenon is avoided, or at least minimized, by covering the bottom surface of the vaporization chamber with materials selected to improve spreading out, and for absorption, of water, i.e. to reduce the size of water droplets. In addition, the coverings are of materials providing thermal insulation, so that the surface across which the water spreads has a somewhat lower temperature than the material forming the bottom of the vaporization chamber. Thus, the influences tending to oppose vaporization are counteracted.

It is of course obvious that all of the materials utilized must be selected in a manner to satisfactorily withstand the thermal conditions normally existing in a pressing iron.

This application relates to subject matter disclosed in French Application No. 9211926, filed on Sep. 29, 1992, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. In a steam pressing iron, the improvement comprising:

a soleplate having an ironing surface and having steam outlet openings;

a steam generating structure disposed adjacent said soleplate and defining a water vaporization chamber having a bottom surface;

means for heating water in said vaporization chamber;

a covering of a material which promotes vaporization of water disposed on said bottom surface of said vaporization chamber; and a screen disposed above said covering for distributing water across said covering;

wherein said screen is provided with means for deflecting and distributing water above and on said covering.

2. The iron defined in claim 1, wherein said screen has a lower boundary which faces said covering and lies in a plane, and said means for deflecting and distributing comprise a plurality of bands which project above said plane.

3. The iron defined in claim 2, wherein said screen defines a plurality of screen openings and said bands at least partially surround said screen openings.

4. The iron defined in claim 2, wherein said bands have an average height, perpendicular to said plane, between 0.5 and 5 mm.

5. The iron defined in claim 4, wherein the average height of said bands is between 1 and 3 mm.

6. In a steam pressing iron, the improvement comprising:

a soleplate having an ironing surface and having steam outlet openings;

a steam generating structure disposed adjacent said soleplate and defining a water vaporization chamber having a bottom surface;

means for heating water in said vaporization chamber;

a covering of a material which promotes vaporization of water disposed on said bottom surface of said vaporization chamber; and a screen disposed above said covering for distributing water across said covering, wherein said screen has a coating of a material which is hydrophilic and wettable by water for promoting spreading of water across said screen.

7. The iron defined in claim 6, wherein said coating is made of sodium silicate.

8. In a steam pressing iron, the improvement comprising:

a soleplate having an ironing surface and having steam outlet openings;

a steam generating structure disposed adjacent said soleplate and defining a water vaporization chamber having a bottom surface;

means for heating water in said vaporization chamber;

a covering of a material which promotes vaporization of water disposed on said bottom surface of said vaporization chamber; and a screen disposed above said covering for distributing water across said covering, wherein said screen is in direct contact with said covering.

9. The iron defined in claim 1, wherein said screen is composed of an expanded metal.

10. The iron defined in claim 9, wherein the metal is aluminum or an aluminum alloy.

11. In a steam pressing iron, the improvement comprising:

a soleplate having an ironing surface and having steam outlet openings;

a steam generating structure disposed adjacent said soleplate and defining a water vaporization chamber having a bottom surface;

means for heating water in said vaporization chamber;

a covering of a material which promotes vaporization of water disposed on said bottom surface of said vaporization chamber; and a screen disposed above said covering for distributing water across said covering, wherein said covering comprises at least one layer of a material which is at least one of hydrophilic and wettable by water.

12. The iron defined in claim 1, wherein said covering comprises: a first layer of a material which is hydrophilic, wettable by water, thermally insulting and adherable to said bottom surface of said water vaporization chamber, said first layer being adhered to said bottom surface; and a second layer disposed upon, and adhering to, said first layer, said second layer being of a material which is porous, hydrophilic and wettable by water.

13. The iron defined in claim 12, wherein the material of said second layer is in the form of filaments or fibers.

14. The iron defined in claim 13, wherein the material of said first layer is at least one of sodium silicate, calcium carbonate, a paint, a varnish, a cement, a silica-based compound, a carbonate of an element other than calcium, a metal oxide, an enamel and a substance applied by plasma deposition.

15. In a steam pressing iron, the improvement comprising:

a soleplate having an ironing surface and having steam outlet openings;

a steam generating structure disposed adjacent said soleplate and defining a water vaporization chamber having a bottom surface;

means for heating water in said vaporization chamber;

a covering of a material which promotes vaporization of water disposed on said bottom surface of said vaporization chamber; and a screen disposed above said covering for distributing water across said covering; wherein said covering comprises: a first layer of a material which is hydrophilic, wettable by water, thermally insulting and adherable to said bottom surface of said water vaporization chamber, said first layer being adhered to said bottom surface; and a second layer disposed upon, and adhering to, said first layer, the material of said first layer is at least one of sodium silicate, calcium carbonate, a paint, a varnish, a cement, a silica-based compound, a carbonate of an element other than calcium, a metal oxide, an enamel and a substance applied by plasma deposition, and the material of said second layer is porous, hydrophilic and wettable by water and is in the form of filaments or fibers of at least one of woven fiberglass, an aramid felt, aramid fibers, mineral fibers, carbon fibers, glass fibers, a metallic fabric and expanded micrometallic fabric.

16. The iron defined in claim 13, wherein the material of said second layer contains a thermally conductive ingredient.

17. The iron defined in claim 13, wherein the thermally conductive ingredient is a metallic paste of aluminum or zinc.

18. The iron defined in claim 13, wherein said second layer has a weight per unit area of between 30 and 500 $g/m^2$.

19. The iron defined in claim 18, wherein the weight per unit area of said second layer is between 100 and 150 $g/m^2$.

20. In a steam pressing iron, the improvement comprising:

a soleplate having an ironing surface and having steam outlet openings;

a steam generating structure disposed adjacent said soleplate and defining a water vaporization chamber having a bottom surface;

means for heating water in said vaporization chamber;

a covering of a material which promotes vaporization of water disposed on said bottom surface of said vaporization chamber; and a screen disposed above said covering for distributing water across said covering; wherein said covering comprises: a first layer of a material which is hydrophilic, wettable by water, thermally insulting and adherable to said bottom surface of said water vaporization chamber, said first layer being adhered to said bottom surface; and a second layer disposed upon, and adhering to, said first layer, said second layer being of a material which is porous, hydrophilic and wettable by water and is in the form of filaments or fibers, wherein said screen has a plurality of openings with a first average dimension and said second layer has a plurality of openings with a second average dimension which is smaller than the first average dimension.

21. In a steam pressing iron, the improvement comprising:

a soleplate having an ironing surface and having steam outlet openings;

a steam generating structure disposed adjacent said soleplate and defining a water vaporization chamber having a bottom surface;

means for heating water in said vaporization chamber;

a covering of a material which promotes vaporization of water disposed on said bottom surface of said vaporization chamber; and a screen disposed above said covering for distributing water across said covering, wherein said screen has at least two side edges which extend away from said covering and via which said screen is held in position by being pressed against said covering.

* * * * *